US009573786B2

(12) United States Patent
Moon

(10) Patent No.: US 9,573,786 B2
(45) Date of Patent: Feb. 21, 2017

(54) DIVERTER, MEDIUM HANDLING APPARATUS AND FINANCIAL DEVICE

(71) Applicant: LG CNS CO., LTD., Seoul (KR)

(72) Inventor: Changho Moon, Seoul (KR)

(73) Assignee: LG CNS CO., LTD., Seoul (KR)

( * ) Notice: Subject to any disclaimer, the term of this patent is extended or adjusted under 35 U.S.C. 154(b) by 0 days.

(21) Appl. No.: 14/586,125

(22) Filed: Dec. 30, 2014

(65) Prior Publication Data

US 2015/0344255 A1 Dec. 3, 2015

(30) Foreign Application Priority Data

May 27, 2014 (KR) ..... 10-2014-0063893

(51) Int. Cl.
*B65H 29/58* (2006.01)
*B65H 29/60* (2006.01)

(52) U.S. Cl.
CPC ..... *B65H 29/58* (2013.01); *B65H 29/60* (2013.01); *B65H 2301/448* (2013.01);
(Continued)

(58) Field of Classification Search
CPC ... B65H 29/58; B65H 29/60; B65H 2301/448; B65H 2404/63; B65H 2404/631; B65H 2404/632; B65H 2404/633; B65H 2405/1134; B65H 3/5253; B65H 3/5215; B65H 3/5246
See application file for complete search history.

(56) References Cited

U.S. PATENT DOCUMENTS 8,985,303 B2 3/2015 Okamoto et al.
9,053,597 B1 * 6/2015 Sackfield ..... B65H 29/58
(Continued)

FOREIGN PATENT DOCUMENTS

JP 2000355440 A 12/2000
JP 2003054811 A 2/2003
(Continued)

OTHER PUBLICATIONS

Office Action dated Aug. 3, 2015 in Korean Application No. 10-2014-0063893.
(Continued)

*Primary Examiner* — Jeremy R Severson
(74) *Attorney, Agent, or Firm* — Saliwanchik, Lloyd & Eisenschenk

(57) ABSTRACT

A diverter, medium handling apparatus and financial devices using the same are provided. The diverter comprises a rotation shaft, at least one first blade connected to the rotation shaft to rotate together with the rotation shaft, and one or more second blades idly coupled to the rotation shaft. When the rotation shaft rotates to divert a transfer path of a medium, each of the second blades rotates after the first blade rotates at a predetermined angle. According to the diverter, the medium handling apparatus, the financial device, the diverter may prevent a jam generated when a unstable medium that is crumpled or bent collides with the rotation shaft disposed in a branch part on the transfer path from occurring and prevent the medium from being torn. Therefore, the financial device may be easy to maintenance and prevent the medium from being jammed and torn to minimize inconvenience to the user.

11 Claims, 6 Drawing Sheets

(52) U.S. Cl.
CPC ..... *B65H 2402/31* (2013.01); *B65H 2404/63* (2013.01); *B65H 2404/632* (2013.01); *B65H 2701/1912* (2013.01)

(56) References Cited

U.S. PATENT DOCUMENTS

| | | | | |
|---|---|---|---|---|
| 2013/0181397 | A1* | 7/2013 | Nunn | B65H 39/10 271/303 |
| 2013/0248322 | A1* | 9/2013 | Okamoto | B65G 47/52 198/367 |
| 2013/0311366 | A1* | 11/2013 | Han | G07F 19/20 705/43 |
| 2015/0194004 | A1* | 7/2015 | Sackfield | B65H 29/58 194/346 |

FOREIGN PATENT DOCUMENTS

| | | | |
|---|---|---|---|
| JP | 2008021140 | A | 1/2008 |
| JP | 2013023384 | A | 2/2013 |

OTHER PUBLICATIONS

Notice of Allowance dated Feb. 22, 2016 in Korean Application No. 10-2014-0063893.

* cited by examiner

DIVERTER, MEDIUM HANDLING APPARATUS AND FINANCIAL DEVICE

CROSS-REFERENCE TO RELATED APPLICATION

This application claims the benefit under 35 U.S.C. §119 of Korean Patent Application No. 10-2014-0063893, filed May 27, 2014, which is hereby incorporated by reference in its entirety.

BACKGROUND

The present disclosure relates to a diverter, a medium handling apparatus, and a financial device.

In general, financial devices are devices that process a financial transaction such as accepting/dispensing a banknote or a check, which is desired by a customer. Also, the banknote and check are called "medium" in common.

Such a financial device may comprise modules for depositing; withdrawing, discrimination, and stacking the medium. Here, the modules may be connected to each other by a plurality of transfer paths. Therefore, the medium may be transferred into each of the modules via the transfer paths.

Here, each of the transfer paths may comprise a portion in which one transfer path is branched into at least two transfer paths, which is called a "branch part".

Also, a diverter for guiding the medium into any one transfer path of the at least two transfer paths may be disposed in the branch part. The diverter may rotate at a predetermined angle to divert a transfer direction of the medium.

However, a diverter disclosed in Korean Patent Publication No. 10-2010-006683 is designed in consideration of a case in which the medium is generally a normal medium without being crumpled or bent, and thus when an unstable medium that is crumpled or bent is inserted into the branch part, the unstable medium collides with a rotation shaft to which the diverter is fixedly coupled. Thus, the medium may be jammed or torn.

BRIEF SUMMARY

Embodiments provide a diverter, a medium handling apparatus, and a financial device.

In one embodiment, a diverter comprises: a rotation shaft; at least one first blade connected to the rotation shaft to rotate together with the rotation shaft; and one or more second blades idly coupled to the rotation shaft, wherein, when the rotation shaft rotates to divert a transfer path of a medium, each of the second blades rotates after the first blade rotates at a predetermined angle.

In another embodiment, a medium handling apparatus comprises: a branch part from which a first path for transferring a medium is branched into a second path and a third path; and a diverter disposed at the branch part to divert a transfer path of the medium, the diverter comprising main and auxiliary guides for guiding the transfer of the medium, wherein the main guide has a rotation angle less than that of the auxiliary guide.

In further another embodiment, a financial device comprises: a customer information acquisition part for acquiring information of a customer; a display part for displaying a menu and information for accepting or dispensing; and a diverter for processing a medium that is accepted or dispensed, the diverter comprising a plurality of guides having rotation angles different from each other.

In still further another embodiment, a diverter comprises: a rotation shaft; a plurality of main guides spaced a predetermined distance apart from each other in a transfer path of a medium and coupled to the rotation shaft; and at least one auxiliary guide disposed in the transfer path of the medium and coupled to the rotation shaft, the at least one auxiliary guide having a size less than that of each of the plurality of main guides.

The details of one or more embodiments are set forth in the accompanying drawings and the description below. Other features will be apparent from the description and drawings, and from the claims.

DETAILED DESCRIPTION

Figure 1:
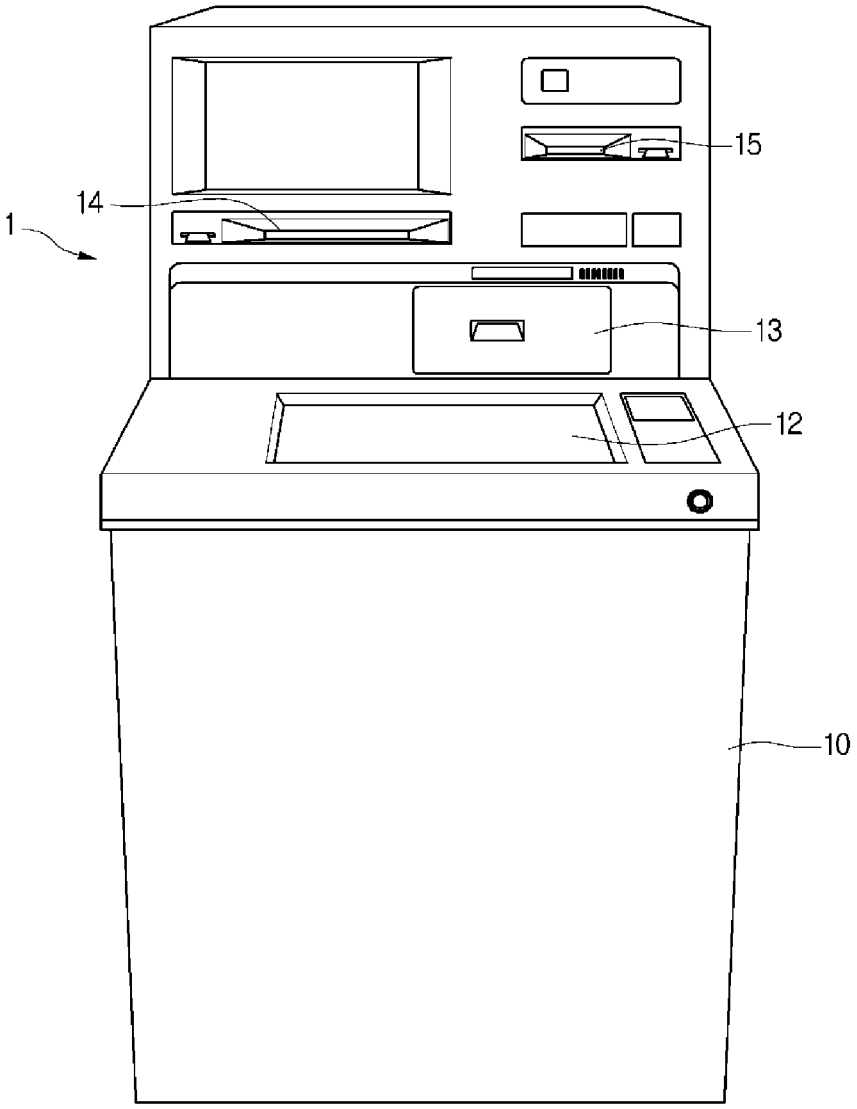
FIG. 1 is a perspective view of a financial device according to an embodiment.

Hereinafter, exemplary embodiments of the present disclosure will be described with reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

A financial device according to embodiments is a device that performs financial businesses, i.e., medium processing comprising processing such as accept processing, giro receipt, or gift certificate exchange and/or processing such as dispensing processing, giro dispensing, or gift certificate dispensing by receiving various media such as, e.g., paper moneys, banknotes, giros, coins, gift certificates, etc. For example, the financial device may comprise an automatic teller machine (ATM) such as a cash dispenser (CD) or a cash recycling device. However, the financial device is not limited to the above-described examples. For example, the financial device may be a device for automatically performing the financial businesses such as a financial information system (FIS).

Hereinafter, assuming that the financial device is the ATM, an embodiment will be described. However, this assumption is merely for convenience of description, and technical idea of the present disclosure is not limited to the ATM.

Figure 2:
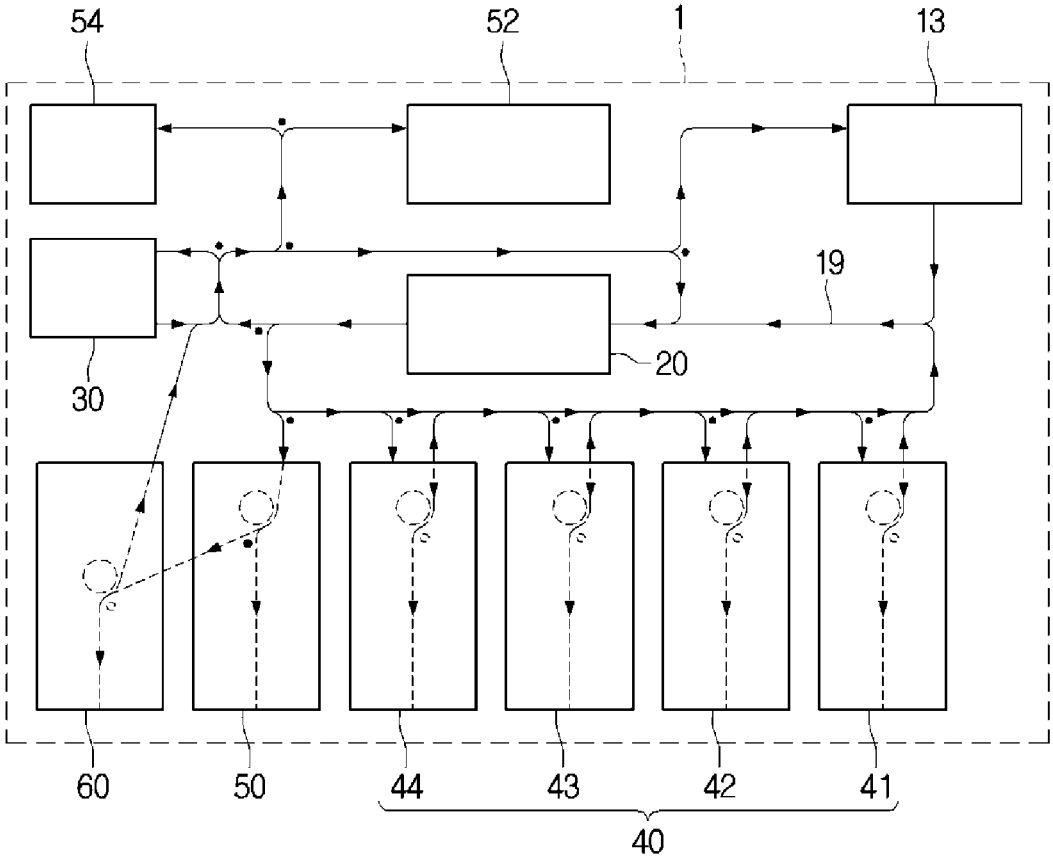
FIG. 2 is a block diagram of the financial device of FIG. 1.

FIG. 1 is a perspective view of a financial device according to an embodiment, and FIG. 2 is a block diagram of the financial device of FIG. 1.

Referring to FIGS. 1 and 2, a financial device 1 according to an embodiment comprises a main body 10 in which a plurality of components are built. The main body 10 comprises a medium accepting and dispensing unit 13 for accepting or dispensing a medium such as a banknote or a check.

The medium accepting and dispensing unit 13 comprises a medium accommodation space that is accessible by a customer. The medium accommodation space may be opened or closed by a blocking member such as a shutter or a cover. Alternatively, the medium accommodation space may be maintained in an opened state without being closed.

Also, the financial device 1 may further comprise a bankbook entrance part 14 for accepting or dispensing a bankbook and a card entrance part 15 for accepting or dispensing a card. The bankbook accepting/dispensing part 14 or the card accepting/dispensing part 15 may be called a customer information acquisition part for acquiring information of a customer. The present disclosure is not limited to a kind of customer information acquisition part. For example, the customer information acquisition part may acquire information recorded in an RFID tag or USB or acquire customer's information by using customer's fingerprint.

Also, the financial device 1 may further comprise a user display part 12 displaying a menu or information for accepting or dispensing and inputting or selecting a command or information for accepting or dispensing.

The financial device 1 comprises a transfer path 19 for guiding the medium. Modules disposed in the financial device 1 may be connected to each other through the transfer path 19. The transfer path 19 may comprise a branch part where a plurality of paths are branched.

Also, a first path A is branched into a second path B and a third path C at the branch part.

A medium handling apparatus for diverting the transfer path 19 of the medium may be disposed in the branch part in which the medium is branched in the transfer path 19. The medium handling apparatus may comprise a diverter (see reference numeral 200 of FIG. 3) that is disposed in the branch part in which a plurality of paths meet to divert the paths of the medium.

The financial device 1 may further comprise a discrimination part 20. The discrimination part 20 may distinguish a kind of media or determine faulty media when media are taken in or out. The financial device 1 may further comprise a banknote temporary integration part 30 in which the banknote is temporarily integrated. The banknote temporary integration part 30 may temporarily store a banknote accepted through the medium entrance part 13 when the customer intends to accept the banknote into the financial device 1. The banknote integrated in the banknote temporary integration part 30 may be transferred into the medium storage boxes 41, 42, and 43 that will be described later when banknote acceptance is finally determined by the customer.

The financial device 1 may further comprise a medium storage box 40 for storing media. The medium storage box 40 may comprise one or more banknote storage boxes 41, 42, and 43 and at least one check storage box 44. This specification is not limited to the number of banknote storage boxes 41, 42, and 43 and check storage box 44.

The medium storage box 40 may have a medium inlet for accepting the transferred medium and a medium outlet for dispensing the medium integrated in the medium storage box 40 to the outside. In general, the medium inlet and the medium outlet may be disposed in an upper end of the box that defines an outer appearance of the medium storage box 40. The medium inlet and the medium outlet may be provided as a single structure or be provided separately with respect to each other.

Also, a medium stacking unit for staking media transferred from the outside of the medium storage box 40 in parallel to each other and a medium pick-up unit for separating the stacked media one by one to transmit the separated medium to the outside of the medium storage box 40 are disposed in the medium storage box 40. The specific constitution of each of the banknote storage boxes 41, 42, and 43 of the medium storage box 40 may be realized as the previously known constitution. In this specification, the structure of each of the banknote storage boxes 41, 42, or 43 and whether the banknote is discharged or inserted are not limited to the above-described example.

The financial device 1 may further comprise a check deposit box 54. A check that is normally accepted may be stored in the check deposit box 54. The check deposit box 54 and the check storage box 44 may be provided as separate modules. For another example, the check deposit box 54 and the check storage box 44 may be provided in a single storage box. However, an inner space of the single storage box may be partitioned into a space in which the check to be accepted is stored and a space in which the check to be dispensed is stored.

The financial device 1 may further comprise a first recovery box 50 for storing a medium that is determined as faulty in the accepting process and a second recovery box 52 for storing a banknote or a check that is determined as faulty in the dispensing process, and a recovery supplement box 60. Each of the first and second recovery boxes 50 and 52 may be provided in plurality. Also, the first and second recovery boxes 50 and 52 may be used as a check recovery box and a banknote recovery box, respectively.

The recovery supplement box 60 may supplement the banknote or the check into the banknote storage boxes 41, 42, and 43 or the check storage box 44 or recover the banknote or the check from the banknote storage boxes 41, 42, and 43 or the check storage box 44. Alternatively, the financial device 1 may further comprise a third recovery box (not shown) in which the medium discharged into the medium entrance part 13 to dispense the medium is recovered when the medium is not received by the customer.

The recovery boxes 50 and 52 and the recovery supplement box 60 may be omitted in the financial device 1. Also, the present disclosure is not limited to the number of recovery boxes 50 and 52 and the number of recovery supplement box 60.

Figure 3:
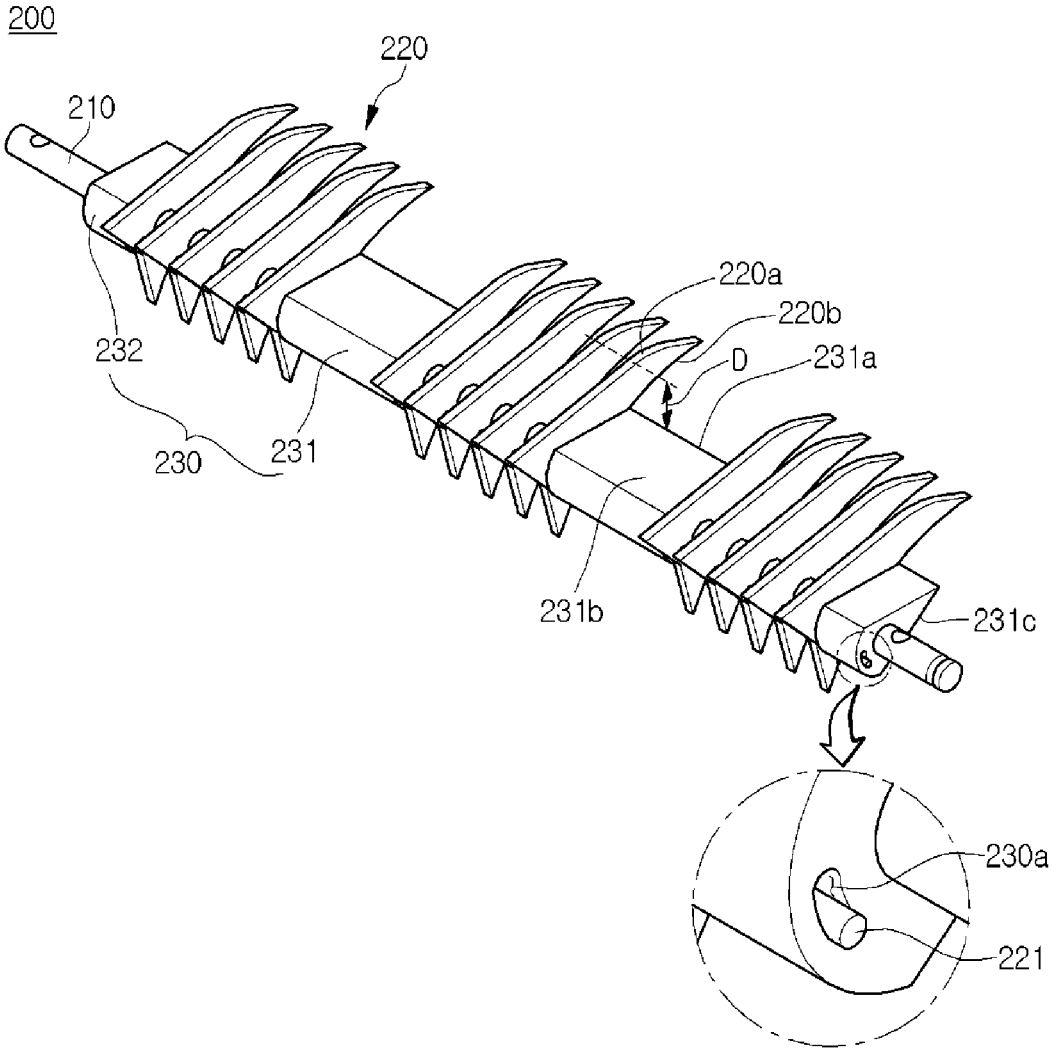
FIG. 3 is a perspective view of a diverter of the financial device of FIG. 1.
Figure 4:
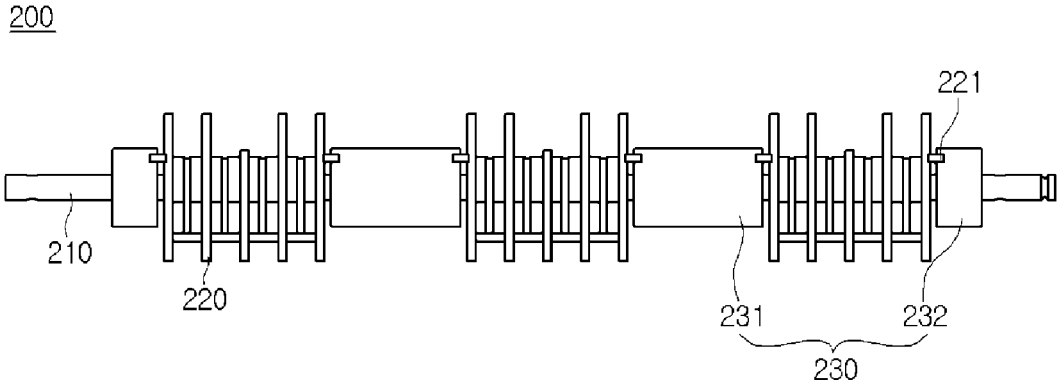
FIG. 4 is a front view of the diverter of FIG. 3.

FIG. 3 is a perspective view of a diverter of the financial device of FIG. 1, and FIG. 4 is a front view of the diverter of FIG. 3.

Referring to FIGS. 3 and 4, the diverter 200 of the financial device 1 may comprise a rotation shaft 210, a main blade 220, and an auxiliary blade 230.

The auxiliary blade 230 is fixedly coupled to the rotation shaft 210 that is rotatably disposed on a frame (not shown) within the financial device 1. The auxiliary blade 230 may rotate together when the rotation shaft 210 rotates.

The main blade 220 may be relatively rotatably coupled to the rotation shaft 210. That is, the main blade 220 may be idly coupled to the rotation shaft 210. Also, the main blade 220 rotates with respect to the rotation shaft 210 to divert the transfer path of the medium. Also, the main blade 220 may comprise a first main guide surface 220*a* and a second main guide surface 220*b* for guiding the transfer of the medium.

A protrusion 221 may be formed on a side surface of the main blade 220. Also, a hole 230*a* having a curved shape to which the protrusion 221 is inserted may be defined in a side surface of the auxiliary blade 230.

The protrusion 221 of the main blade 220 and the hole 230*a* of the auxiliary blade 230 may be provided to allow the main blade 220 idly coupled to the rotation shaft 210 to rotate together when the auxiliary blade 230 rotates.

Here, the hole 230*a* has a diameter greater than that of the protrusion 221. Thus, the main blade 220 does not rotate before the auxiliary blade 230 rotates at a predetermined angle, and the main blade 220 rotates together with the auxiliary blade 230 after the auxiliary blade 230 rotates at a predetermined angle.

Although each of the protrusion 221 and the hole 230*a* are defined in the main and auxiliary blades 220 and 230 in the above embodiment, on the contrary, the hole 230*a* may be defined in the side surface of the main blade 220, and the protrusion 221 may be formed on the side surface of the auxiliary blade 230.

The main blade 220 may be provided in plurality, and the plurality of main blades 220 may be disposed spaced apart from each other on the rotation shaft 210.

The auxiliary blade 230 may comprise an inner auxiliary blade 231 and an outer auxiliary blade 232. The inner auxiliary blade 231 may be disposed between the plurality of main blades 220, and the outer auxiliary blade 232 may be disposed at the outside of the plurality of main blades 220.

Generally, the medium may be crumpled or bent during its use by the customer or during a transfer process in the financial device 1.

In the present disclosure, the crumpled or bent medium as describe above may be defined as an unstable medium.

The unstable medium may cause a jam that is generated by colliding with the rotation shaft 210 while the unstable medium is transferred through the transfer path 19.

In the present disclosure, the auxiliary blade 230 may guide the transfer or the crumpled or bent portion of the unstable medium to prevent the jam that is generated when the unstable medium collides with the rotation shaft 210. More particularly, the inner auxiliary blade 231 may prevent the unstable medium of which a central portion is crumpled or bent from colliding with the rotation shaft 210. Also, the outer auxiliary blade 232 may prevent the unstable medium of which one or both ends are crumpled or bent from colliding with the rotation shaft 210.

Figure 5:
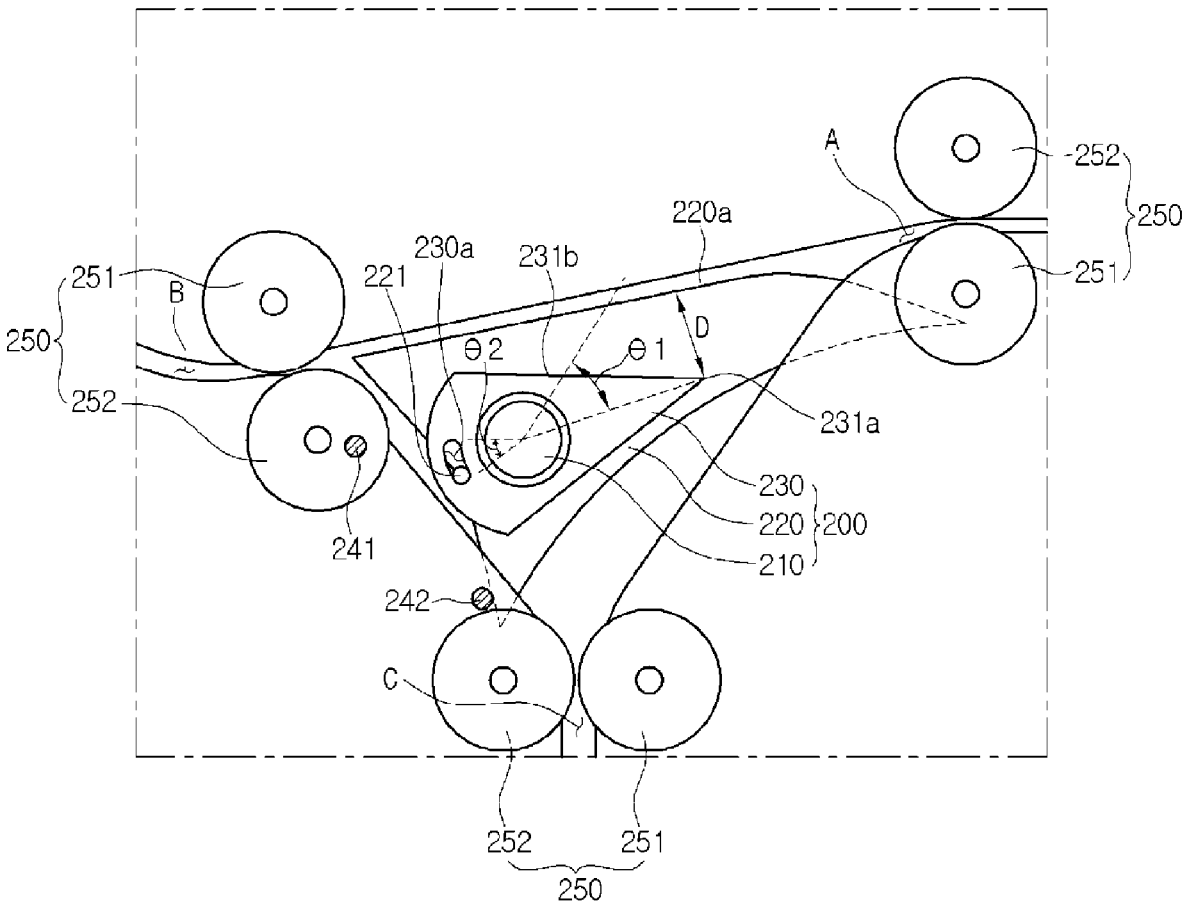
FIGS. 5 and 6 are views illustrating an operation state of the diverter of FIG. 3 in the financial device of FIG. 1.
Figure 6:
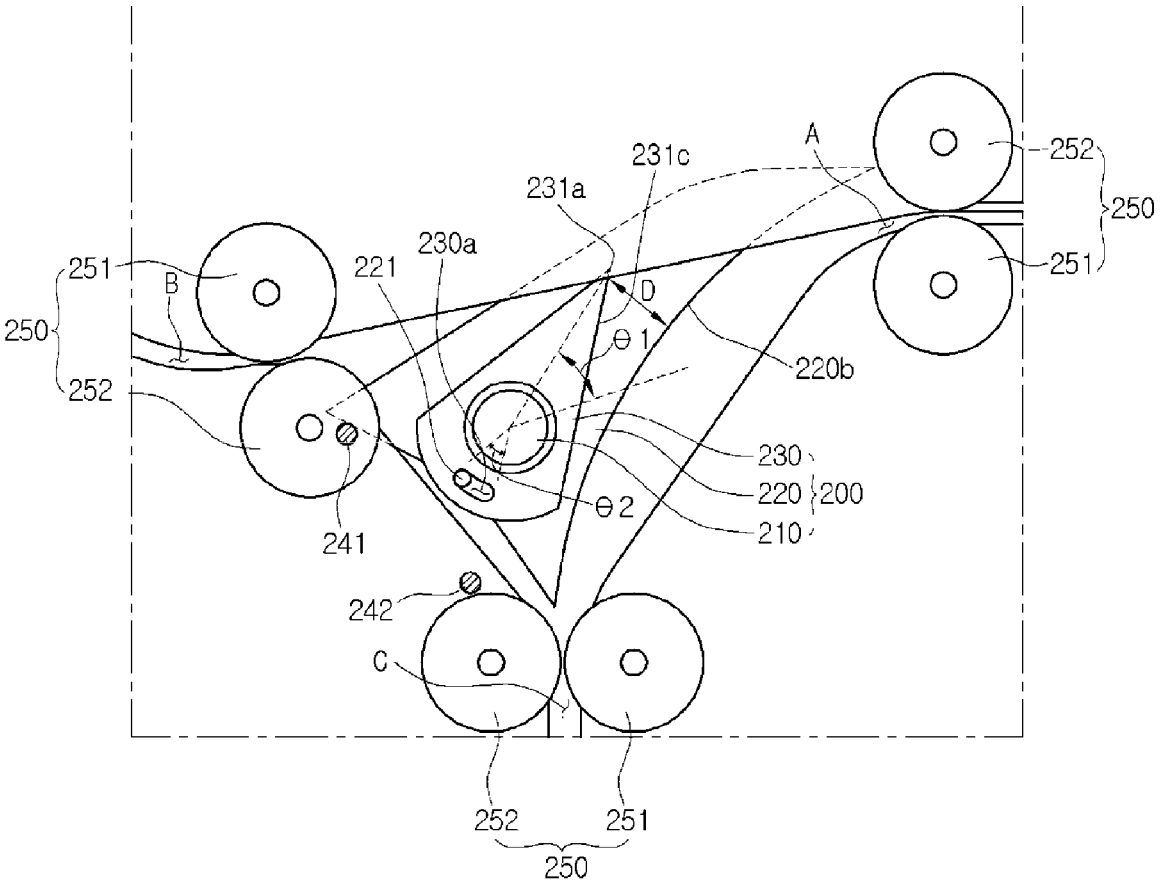

FIGS. 5 and 6 are views illustrating an operation state of the diverter of FIG. 3 in the financial device of FIG. 1.

Hereinafter, operation principles of the diverter 200 will be described with reference to FIGS. 5 and 6.

FIG. 5 is a view illustrating a state in which the first path A communicates with the second path B by the diverter 200, and FIG. 6 is a view illustrating a state in which the first path A communicates with the third path C by the diverter 200.

Since the main blade 220 is idly rotatably coupled to the rotation shaft 210, even though the rotation shaft 210 rotates in a predetermined angle θ2 by an actuator (not shown) that transmits a rotational force to the rotation shaft 210, the main blade 220 may not rotate. The actuator may be realized as a solenoid, a swing selector, and a motor.

That is, when the rotation shaft 210 has a rotation angle between 0° and θ2, only the auxiliary blade 230 may rotate. Also, when the rotation shaft 210 has a rotation angle greater than θ2, an inner surface of the hole 230*a* defined in the side surface of the auxiliary blade 230 may pressurize the protrusion 221 formed on the side surface of the main blade 220. Thus, the main and auxiliary blades 220 and 230 may rotate together. Therefore, the rotation angle θ1 of the auxiliary blade 230 is different from that θ1 to θ2 of the main blade 220.

Also, the rotation angle of the main blade 220 may be controlled by first and second stoppers 241 and 242 that are fixedly coupled to the inside of the financial device. As illustrated in FIG. 5, when the main blade 220 rotates so that the first path A communicates with the second path B, the main blade 220 rotates in a clockwise direction on FIG. 5. Here, when the main blade 220 rotates at a predetermined angle, the main blade 220 contacts the second stopper 242 to stop the rotation thereof.

Hereinafter, a process of transferring the medium will be described with reference to FIGS. 3, 5, and 6.

Referring to FIGS. 3 and 5, the medium may be transferred from the first path A into the second path B by a roller 250, i.e., a transfer roller 251 and a guide roller 252 in a state where the first path A communicates with the second path B by the main blade 220.

In this case, the medium may pass through a connection path through which the first path A is connected to the second path B, which is defined by the first main guide surface 220*a* of the main blade 220.

According to the difference between the rotation angles of the auxiliary and main blades 230 and 220, a gap D may be defined between an end 231*a* of the auxiliary blade 230 and the first main guide surface 220*a* of the main blade 220. Thus, transfer of a portion of the medium, which is not in contact with the first main guide surface 220*a* of the main blade 220, may be guided by a first auxiliary guide surface 231*b* of the auxiliary blade 230.

Also, referring to FIGS. 3 and 6, the medium may be transferred from the first path A into the third path C by the transfer roller 251 and the guide roller 252 in a state where the first path A communicates with the third path C by the main blade 220.

In this case, the medium may pass through a connection path through which the first path A is connected to the third path C, which is defined by the second main guide surface 220*b* of the main blade 220.

According to the difference between the rotation angles of the auxiliary and main blades 230 and 220, a gap D may be defined between the end 231*a* of the auxiliary blade 230 and the second main guide surface 220*b* of the main blade 220. Thus, transfer of a portion of the medium, which is not in contact with the second main guide surface 220*b* of the main blade 220, may be guided by a second auxiliary guide surface 231*c* of the auxiliary blade 230.

Hereinafter, a process in which the transfer path of the medium is diverted by the diverter 200 will be described with reference to FIGS. 3, 5, and 6.

As illustrated in FIG. 5, so as to divert the transfer path of the medium from the first path A into the third path C in a state where the first path A is connected to the second path B, the rotation shaft 210 may rotate in a counterclockwise direction on FIG. 5 according to an operation of the actuator.

Then, the auxiliary blade 230 rotates together with the rotation shaft 210, and the main blade 220 rotates in a counterclockwise direction together with the rotation shaft 210 after the rotation shaft 210 rotates at a predetermined angle θ2. While the main blade 220 rotates in the counterclockwise direction, the main blade 220 contacts the first stopper 241 to stop the rotation thereof, and thus, the first path A is connected to the third path C.

Also, as illustrated in FIG. 6, so as to divert the transfer path of the medium from the first path A into the second path B in a state where the first path A is connected to the third path C, the rotation shaft 210 may rotate in a clockwise direction on FIG. 5 according to an operation of the actuator.

Then, the auxiliary blade 230 rotates together with the rotation shaft 210, and the main blade 220 rotates in a clockwise direction together with the rotation shaft 210 after the rotation shaft 210 rotates at a predetermined angle θ2. While the main blade 220 rotates in the clockwise direction, the main blade 220 contacts the first stopper 242 to stop the rotation thereof, and thus, the first path A is connected to the second path B.

In the current embodiment, since the main blade 220 is idly rotatably coupled to the rotation shaft 210, the main blade 220 may rotate to a position that is not appropriate for guiding the transfer of the medium by a reaction force generated when the rotation of the main blade 220 is stopped while rotating, an impact of the medium, which is transferred after the rotation is completed, or other external forces. Here, a transfer error such as the jam may occur during the transfer of the medium. However, according to the current embodiment, the main blade 220 may be fixed to a desired position by the stopper 242 and the actuator. That is, referring to FIG. 5, when the main blade 220 contacts the second stopper 242 to stop the rotation thereof, the rotation in the clockwise direction may be prevented by the second stopper 242, and the rotation in the counterclockwise direction may be prevented by the rotation shaft 210 rotating by the actuator and the auxiliary blade 230 rotating together with the rotation shaft 210. Also, referring to FIG. 6, when the main blade 220 contacts the first stopper 241 to stop the rotation thereof, the rotation in the counterclockwise direction may be prevented by the first stopper 241, and the rotation in the clockwise direction may be prevented by the rotation shaft 210 rotating by the actuator and the auxiliary blade 230 rotating together with the rotation shaft 210. Thus, according to the current embodiment, even when the main blade 220 is idly coupled to the rotation shaft 210, the main blade 220 may stably guide the transfer of the medium.

In the current embodiment, since the main blade 220 rotates after the main blade 230 rotates at a predetermined angle, a gap between the end 231*a* of the auxiliary blade 230 and the first and second main guide surfaces 220*a* and 220*b* of the main blade 220 may be defined to prevent the medium from being torn or jammed due to the collision of the medium and the end 231*a* of the auxiliary blade 230 during the transfer of the medium.

In the above embodiments, referring to the rotation processes of the auxiliary and main blades 230 and 220, when the rotation shaft 210 rotates, the main blade 220 rotates after the auxiliary blade 230 rotates. Thus, the auxiliary blade 230 may be referred to as a first blade, and the plurality of main blades 220 may be referred to as second blades. Also, the first blade may comprise a first inner blade disposed between the second blades and a first outer blade disposed at the outside of the second blade.

Also, the diverter 200 may be called a diverting device.

In the current embodiment, an assembly of the plurality of main blades 220 may constitute one main guide. Also, the assembly of the plurality of the auxiliary blades 230 may constitute one auxiliary guide. Then, the diverter according to the current embodiment may comprise a plurality of main guides and at least one auxiliary guide.

Although the auxiliary blade 230 rotates the main blade 220 when the rotation shaft 210 rotates in the above embodiments, the present disclosure is not limited thereto. For example, a protrusion (not shown) is formed on one of the rotation shaft 210 and the main blade 220, and a hole (not shown) having a curved shape to which the protrusion is inserted is defined in the other one of the rotation shaft 210 and the main blade 220, and thus the main blade 220 may rotate after the rotation shaft 210 rotates at a predetermined angle.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or includes or has) some elements, it should be understood that it may comprise (or include or has) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

What is claimed is:

1. A diverter comprising:

a rotation shaft;

at least one first blade connected to the rotation shaft to rotate together with the rotation shaft; and one or more second blades idly coupled to the rotation shaft;

wherein, when the rotation shaft rotates to divert a transfer path of a medium, each of the second blades rotates after the first blade starts rotating at a predetermined angle, and wherein the at least one first blade and the one or more second blades are alternately coupled to the rotation shaft in a longitudinal direction of the rotation shaft.

2. The diverter of claim 1, wherein the first blade comprises:

a first inner blade disposed between the second blades, and a first outer blade disposed outside the second blades.

3. The diverter of claim 1, wherein the first blade is disposed outside the one or more second blades.

4. The diverter of claim 1, wherein a protrusion is disposed on one of the first and second blades, and a hole into which the protrusion is inserted is defined in the other one of the first and second blades.

5. The diverter of claim 4, wherein the hole has a curved shape.

6. The diverter of claim 4, wherein the hole has a diameter greater than that of the protrusion.

7. The diverter of claim 1, wherein a protrusion is disposed on the rotation shaft, and a hole having a curved shape into which the protrusion is inserted is defined in the second blades.

8. The diverter of claim 1, wherein a shortest distance between the rotation shaft and a guide surface of the first blade is shorter than that between the rotation shaft and a guide surface of the second blades.

9. The diverter of claim 1, wherein the second blades each has a rotation angle smaller than that of the first blade.

10. A medium handling apparatus comprising:

a branch part from which a first path for transferring a medium is branched into a second path and a third path; and a diverter disposed at the branch part to divert a transfer path of the medium, the diverter comprising main and auxiliary guides for guiding the transfer of the medium, wherein the main guide has a rotation angle smaller than that of the auxiliary guide, and a rotation shaft to which each of the main and auxiliary guides is coupled;

wherein the auxiliary guide is coupled to the rotation shaft to rotate together with the rotation shaft, wherein the main guide is idly coupled to the rotation shaft to rotate, and wherein the main guide and the auxiliary guide are alternately coupled to the rotation shaft in a longitudinal direction of the rotation shaft.

11. The medium handling apparatus of claim 10, wherein, when the rotation shaft rotates to divert the transfer path of the medium, the main guide rotates after the auxiliary guide starts rotating at a predetermined angle.

* * * * *